US009456708B2

(12) United States Patent
Theisen et al.

(10) Patent No.: US 9,456,708 B2
(45) Date of Patent: Oct. 4, 2016

(54) MERCHANDISER

(71) Applicant: Target Brands, Inc., Minneapolis, MN (US)

(72) Inventors: Jennifer A. Theisen, Crystal, MN (US); Erin L. Zobel, Minneapolis, MN (US)

(73) Assignee: Target Brands, Inc., Minneapolis, MN (US)

( * ) Notice: Subject to any disclaimer, the term of this patent is extended or adjusted under 35 U.S.C. 154(b) by 189 days.

(21) Appl. No.: 14/163,679

(22) Filed: Jan. 24, 2014

(65) Prior Publication Data

US 2015/0208831 A1 Jul. 30, 2015

(51) Int. Cl.
*A47F 5/08* (2006.01)
*A47F 5/00* (2006.01)

(52) U.S. Cl.
CPC ..... *A47F 5/0823* (2013.01); *A47F 5/0018* (2013.01); *Y10T 29/49826* (2015.01)

(58) Field of Classification Search
CPC ..... A47F 5/08; A47F 5/0807; A47F 5/0815; A47F 5/0823; A47F 5/0846; A47F 3/004; A47F 5/0018; A47B 87/008; A47B 47/047
USPC ..... 211/87.01; 312/122, 119, 117, 201, 312/246, 234.1, 234.4, 234, 249.1; 248/220.41
See application file for complete search history.

(56) References Cited

U.S. PATENT DOCUMENTS 2,943,835 A * 7/1960 Tierney ..... A47F 5/0815 248/220.41
3,190,243 A * 6/1965 Pira ..... A47B 57/46 108/152
3,193,231 A * 7/1965 Curry ..... A47F 5/0823 24/DIG. 52
3,744,868 A * 7/1973 Reiter ..... A47B 47/04 312/198
4,322,006 A * 3/1982 Marschak ..... A47F 5/0823 211/126.2
4,401,222 A 8/1983 Kulikowski et al.
4,687,094 A * 8/1987 Allsop ..... A47F 5/0823 206/45.26
5,097,771 A * 3/1992 James, III ..... A47B 23/00 108/108
5,152,593 A * 10/1992 Domenig ..... A47B 95/008 248/205.2

(Continued)

FOREIGN PATENT DOCUMENTS

FR 2927784 A1 * 8/2009 ..... A47B 47/00

*Primary Examiner* — Stanton L Krycinski
(74) *Attorney, Agent, or Firm* — Leanne Taveggia Farrell; Westman, Champlin & Koehler, P.A.

(57) ABSTRACT

A display apparatus includes a merchandiser box and an adapter. The merchandiser box has an exterior bottom surface and an interior space defined by a back, a pair of sides, an interior bottom surface, a top and a front having a window. The interior space supports and displays merchandise. The adapter couples the back of the merchandiser box to a wall of a display fixture such that the exterior bottom surface of the merchandiser box is exposed along its entirety. The adapter includes at least one slot for receiving at least one hook located on an exterior of the back of the merchandiser box.

15 Claims, 10 Drawing Sheets

(56) References Cited

U.S. PATENT DOCUMENTS 5,215,200 A * 6/1993 Rosenthal ..... A47F 5/0823 211/187
5,309,686 A * 5/1994 Underwood ..... A47B 83/001 160/135
5,361,937 A 11/1994 Wiese
5,718,493 A * 2/1998 Nikolai ..... A47B 88/0014 312/245
6,003,685 A * 12/1999 Malin ..... A47F 5/0861 211/59.1
6,585,118 B2 * 7/2003 Kellogg ..... A47F 3/001 211/13.1
6,622,979 B2 * 9/2003 Valiulis ..... A47F 5/0861 211/59.1
6,758,349 B1 7/2004 Kwap et al.
7,175,034 B2 2/2007 Nook et al.
7,367,460 B2 5/2008 Hirsch
7,428,972 B2 * 9/2008 Warner ..... A47F 5/0823 211/59.1
7,441,736 B2 * 10/2008 Wiltfang ..... A47F 5/0823 211/87.01
7,909,184 B2 * 3/2011 Clark ..... A47F 5/08 211/189
7,921,615 B2 * 4/2011 Picchio ..... A47B 95/008 211/162
7,954,648 B2 6/2011 Takashima et al.
7,997,430 B2 8/2011 Clark et al.
8,042,700 B1 * 10/2011 Smalley ..... A47F 5/0807 211/88.01
8,123,052 B2 2/2012 Clark et al.
8,177,311 B2 5/2012 Apgood, II et al.
8,317,273 B2 11/2012 Alexander
8,499,502 B2 * 8/2013 Browe ..... A61G 17/04 211/85.6
8,832,873 B2 * 9/2014 Kumar ..... A47C 17/54 312/240
9,010,033 B2 * 4/2015 Woods ..... A47B 5/00 52/239
2003/0226784 A1 * 12/2003 Petner ..... A47F 5/0807 206/775
2005/0000926 A1 * 1/2005 Bowers ..... A47F 7/30 211/94.01
2005/0241251 A1 * 11/2005 Browe ..... A61G 17/04 52/311.1
2008/0237159 A1 * 10/2008 Bray ..... A47B 96/027 211/59.2
2009/0039742 A1 * 2/2009 Ripley, Jr. ..... A47F 3/004 312/114
2009/0107940 A1 4/2009 Norman et al.
2010/0044326 A1 2/2010 Meyer-Hanover et al.
2011/0204009 A1 8/2011 Karan
2012/0012547 A1 1/2012 Bergdoll et al.
2012/0285911 A1 11/2012 Valiulis
2015/0102001 A1 * 4/2015 Zobel ..... A47F 5/0823 211/85.28

* cited by examiner

MERCHANDISER

BACKGROUND

A retail store uses gondola display units to organize and present merchandise to customers for purchase. A gondola display unit includes at least a base deck, a pair of uprights and a back wall that vertically extends upward from the base deck and is located between the pair of uprights. The gondola display unit further includes display shelves, peg hooks, horizontal slats and etc. that are supported by the pair of uprights and the back panel and are for presenting merchandise.

Often retailers desire to highlight certain products that are located on a gondola display unit. For example, a retailer may want to bring certain products to the attention of the customer because they were advertised in a certain media format, such as a catalog, a mailer or a commercial. In another example, a retailer may want to highlight certain products that have certain characteristics not possessed by similarly displayed products, such as products that are on sale, new product offerings or products that have associated promotional incentives.

The discussion above is merely provided for general background information and is not intended to be used as an aid in determining the scope of the claimed subject matter.

SUMMARY

A display apparatus includes a merchandiser box and an adapter. The merchandiser box has an exterior bottom surface and an interior space defined by a back, a pair of sides, an interior bottom surface, a top and a front having a window. The interior space supports and displays merchandise. The adapter couples the back of the merchandiser box to a wall of a display fixture such that the exterior bottom surface of the merchandiser box is exposed along its entirety. The adapter includes at least one slot for receiving at least one hook located on an exterior of the back of the merchandiser box A merchandiser includes a base structure, a graphic support structure and a sign holder. The base structure has an interior space defined by a back panel, a pair of side panels, a front having an opening, a bottom panel and a top. The base structure has a width and is configured to display merchandise within the interior space. The graphic support structure has a front, a back, a pair of sides, a top and a bottom. The graphic support structure has a width that is less than the width of the base structure and is insertable through the opening in the front of the base structure and into the interior space of the base structure such that the graphic support structure rests on the bottom panel of the base structure and is located between the pair of side panels, between the front and the back panel and between the top and the bottom panel of the base structure. The sign holder is attached to the front of the graphic support structure and is configured to hold sheet material with printed graphics.

A method of displaying merchandise in a merchandiser includes mounting the merchandiser box for holding merchandise to a wall and spaced apart from shelves of a display fixture and inserting the graphic box through the window in the front of the merchandiser box and into an interior of the merchandiser box such that the graphic box rests on the bottom of the merchandiser box and is located between the pair of sides, between the front window and the back and between the top and the bottom of the merchandiser box.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION OF DRAWINGS

DETAILED DESCRIPTION

Described below are embodiments of a merchandiser for use in displaying, promoting and highlighting merchandise in a retail store. The merchandiser includes a merchandise box and a graphic box. The merchandise box has an interior space and a front window defining the front of the interior space. The graphic box, which includes a sign holder for receiving sheet material with printed graphics, is inserted into and held within in the interior space of the merchandise box. In one embodiment, an adapter couples the back of the merchandiser box to a wall of a display fixture or display unit so that an exterior bottom surface of the merchandiser box is exposed across its entirety and the merchandiser box appears to float above shelves of the display fixture or display unit.

Figure 1:
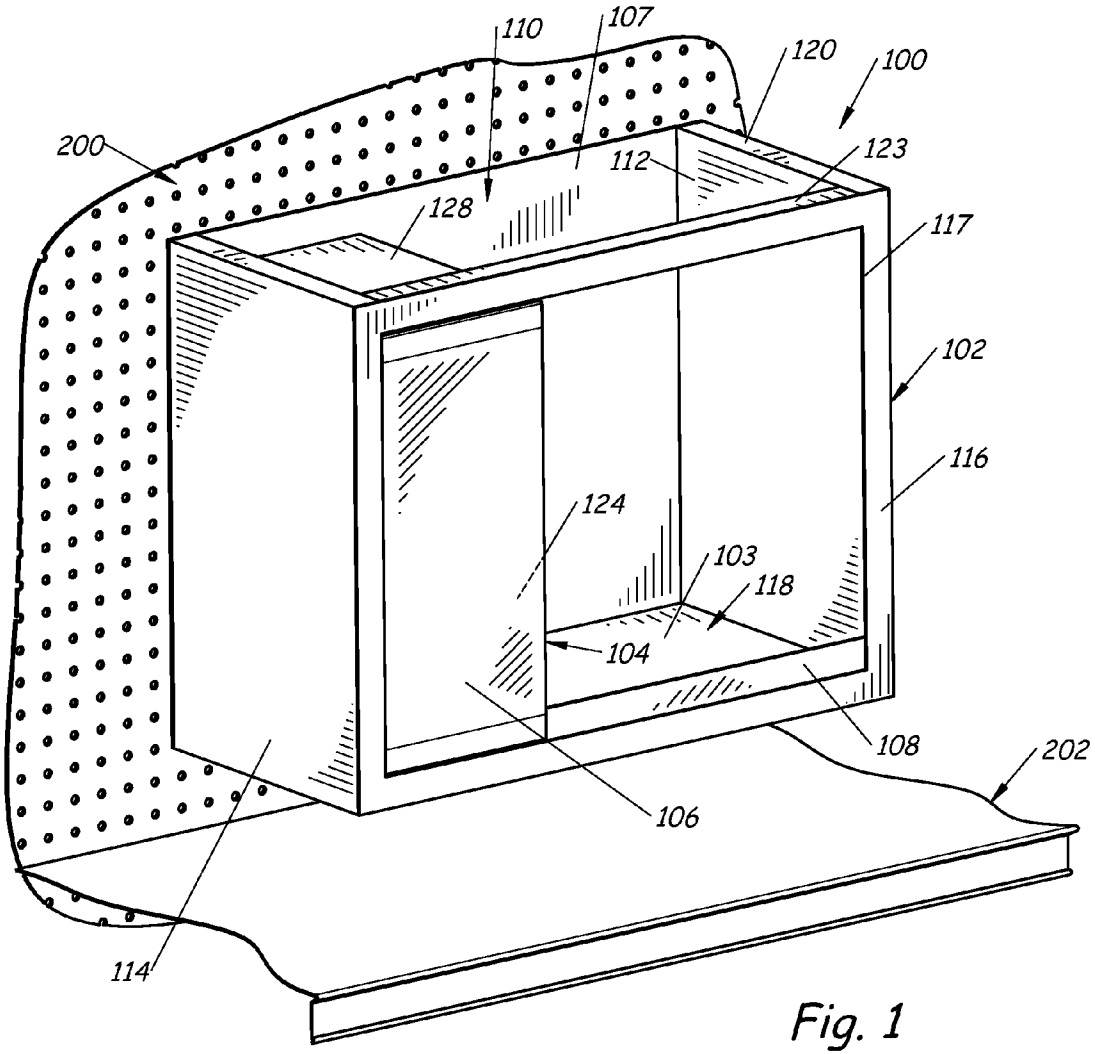
FIG. 1 is a front perspective view of a merchandiser mounted to a wall according to one embodiment.
Figure 2:
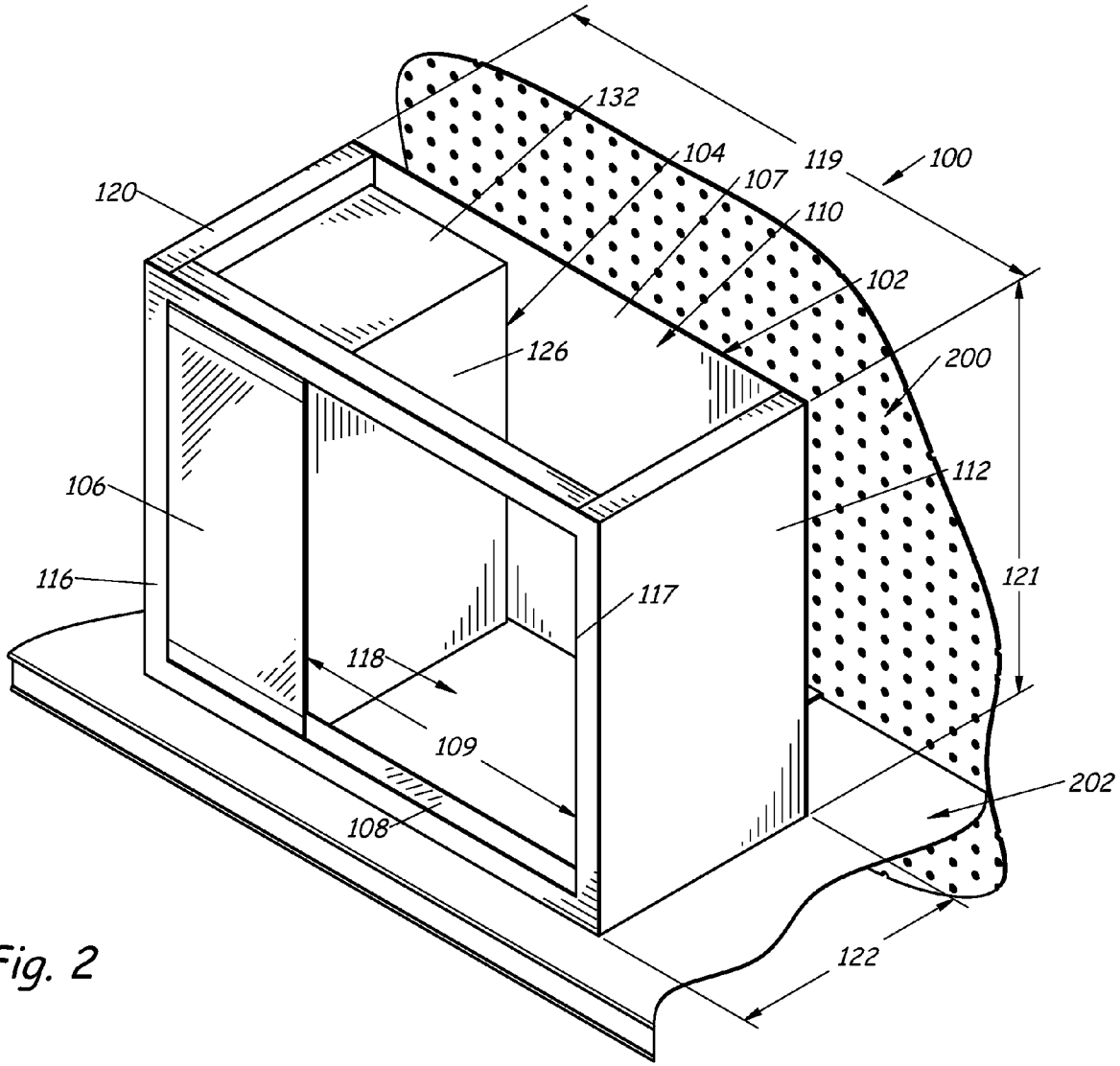
FIG. 2 is a front perspective view of the merchandiser illustrated in FIG. 1 being supported on a shelf according to another embodiment.
Figure 3:
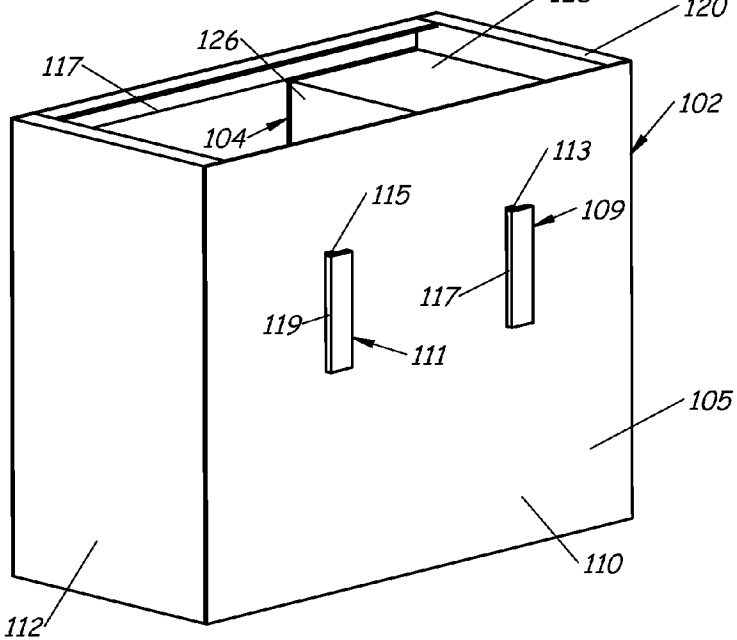
FIG. 3 is a back perspective view of a portion of the merchandiser illustrated in FIGS. 1 and 2.

FIG. 1 is a front perspective view of an assembled merchandiser 100 mounted to a wall 200 and spaced above or apart from a shelf 202 that is also attached to wall 200 according to one embodiment. In this embodiment, merchandiser 100 appears to float above shelf 202. FIG. 2 is a front perspective view of the assembled merchandiser 100 illustrated in FIG. 1 being supported on shelf 202 that is attached to wall 200 according to another embodiment. Merchandiser 100 is an apparatus for displaying merchandise and includes a merchandiser box or base structure 102, a graphic box or graphic support structure 104, a sign holder 106 and a price label holder 108. FIG. 3 is a back perspective view of a portion of merchandiser 100 including merchandiser box 102, graphic box 104, sign holder 106 and price label holder 108 assembled together. FIGS. 4-8 illustrate orthogonal views of the portion of the assembled merchandiser 100 illustrated in FIG. 3 including a front view, a back view, a right side view (the opposing left side view being a mirror image), a top view and a bottom view, respectively.

Figure 4:
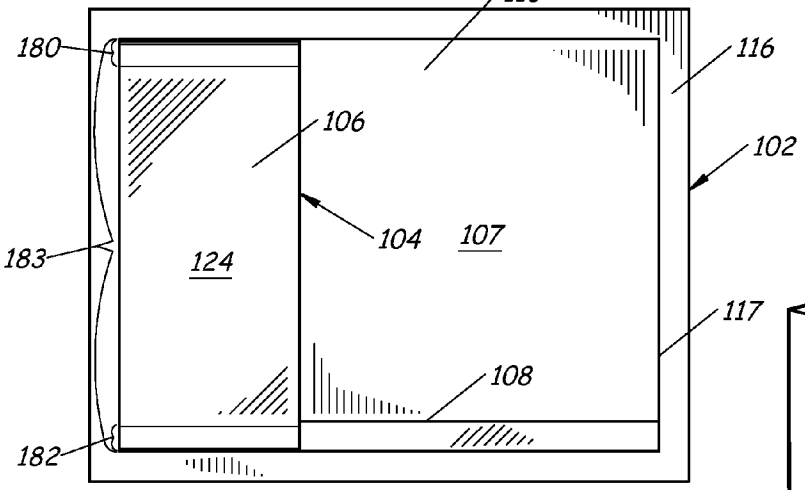
FIG. 4 is a front view of the portion of the merchandiser illustrated in FIG. 3.
Figure 5:
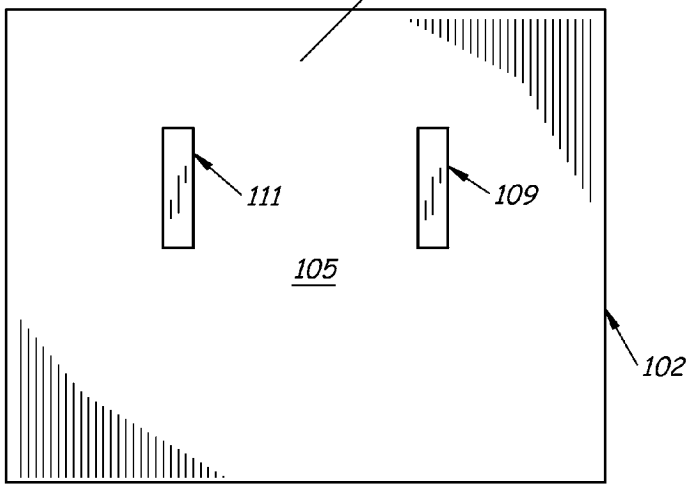
FIG. 5 is a back view of the portion of the merchandiser illustrated in FIG. 3.
Figure 6:
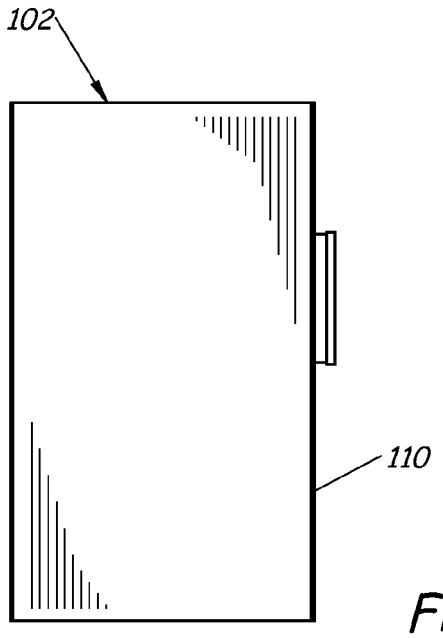
FIG. 6 is a side view of the portion of the merchandiser illustrated in FIG. 3.
Figure 7:
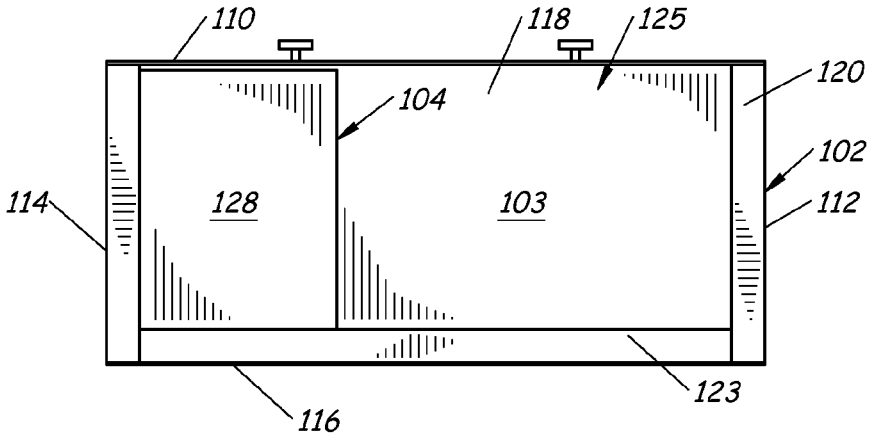
FIG. 7 is a top view of the portion of the merchandiser illustrated in FIG. 3.
Figure 8:
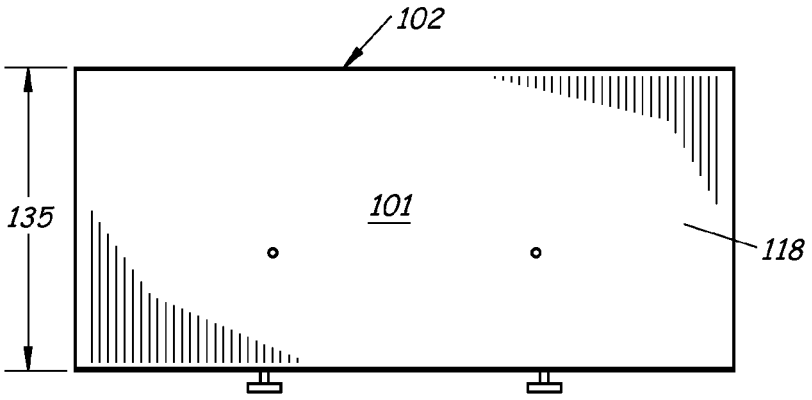
FIG. 8 is a bottom view of the portion of the merchandiser illustrated in FIG. 3.

Merchandiser box or base structure 102 includes a back or back panel 110, a pair of sides or side panels 112 and 114, a front or front panel 116 having an opening or window 117, a bottom or bottom panel 118 and a top 120, which in the embodiments illustrated throughout the application includes the tops of back 110, front 116, sides 112 and 114, a lateral support 123 and an open area 125 (FIG. 7). Bottom or bottom panel 118 includes an exterior bottom surface 101 (FIG. 8) and an interior bottom surface 103 (FIGS. 1, 2 and 7). In the embodiment illustrated in FIG. 1, exterior bottom surface 101 is exposed across its entirety. In the embodiment illustrated in FIG. 2, exterior bottom surface 101 is in contact with shelf 202 and is therefore not exposed across its entirety. Back or back panel 110 includes an exterior surface 105 (FIGS. 3 and 5) and an interior surface 107 (FIGS. 1, 2 and 4). Together, back 110, sides 112 and 114, front 116 and bottom 118 define merchandiser box 102 with an interior space. In addition and as illustrated in FIG. 2, merchandiser box or base structure 102 has a width 119, a height 121 and a depth 122.

Exterior surface 105 of back 110 of merchandiser box 102 includes a pair of hooks 109 and 111. However, exterior surface 105 of back 110 can have any number of hooks including a single hook. As illustrated best in FIG. 3, hooks 109 and 111 include respective bases 113 and 115 that protrude from back 110 and respective main bodies 117 and 119 that extend past the sides of bases 113 and 115 to form a "T" shape as shown in FIG. 7. Hooks 109 and 111 are for use in mounting merchandiser box 102 to a wall and will be discussed in detail below.

Figure 13:
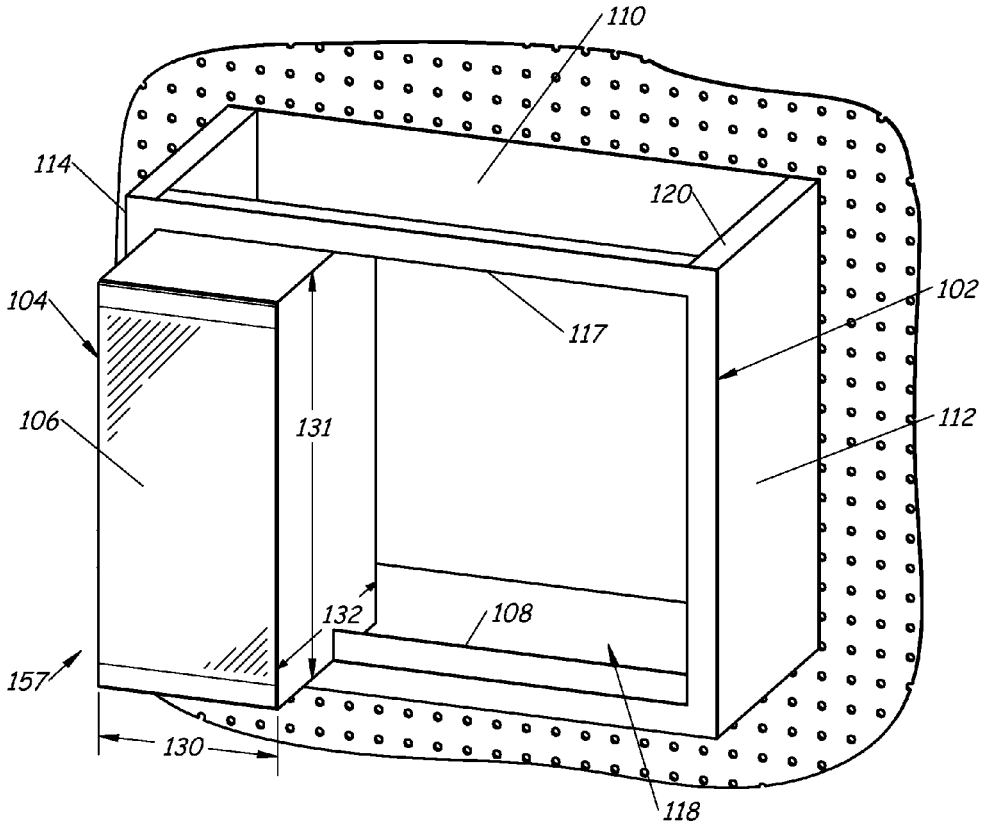
FIG. 13 illustrates a graphic box being inserted into the merchandiser box.

Graphic box or graphic support structure 104 has a front 124, a back (hidden from view), a pair of sides 126 (of which the opposing side from side 126 is hidden from view), a top 128 and a bottom (hidden from view). In addition and as illustrated in FIG. 13, graphic box or graphic support structure 104 has a width 130, a height 131 and a depth 132. All of the dimensions of graphic box 104 are less than the dimensions of merchandiser box 102 including width 130 being less than width 119, height 131 being less than height 121 and depth 132 being less than depth 122. As a result, graphic box 104 is insertable through opening or window 117 into the interior space of merchandiser box 102 such that graphic box rests on interior bottom surface 103 of bottom 118 and is located between the pair of sides 112 and 114, between front 116 and back 110 and between top 120 and bottom 118.

As illustrated in FIGS. 1-4 and 7, the side opposite side 126 of graphic box 104 is located adjacent to side or side panel 114 of merchandiser box 102 when the graphic box is located within the interior space of merchandise box 102. However, it should be realized that side 126 of graphic box 104 might also be located adjacent to side or side panel 112 within the interior space of merchandise box 102 or anywhere between side 112 and side 114. Therefore, while height 131 of graphic box 104 is just slightly smaller than height 121 and depth 132 of graphic box 104 is just slightly smaller than depth 122, width 130 of graphic box 104 is approximately less than one-third of the size of width 119 of merchandise box 102. In this way, approximately over two-thirds of width 119 of merchandiser 102 is for displaying merchandise.

Sign holder 106 is attached to a front surface of front 124 of graphic box 104 and is configured to hold sheet material with printed graphics. In one embodiment and as illustrated, sign holder 106 is made of a sheet of transparent plastic that has been folded at the top and the bottom to form a top attachment section 180 (FIG. 4), a bottom attachment section 182 (FIG. 4) and a middle display section 183 (FIG. 4). Top attachment section 180 is attached to a top of front 124 of graphic box 104 and bottom attachment section 182 is attached to a bottom of front 124 of graphic box 104 by, for example, an adhesive. As a result, middle display section 183 extends over or covers the entire front 124 of graphic box 104. The folds between top attachment section 180 and middle display attachment 183 and bottom attachment section 182 and middle display attachment 183 form channels that that accept and support sheet(s) of printed graphics. In this configuration, sign holder 106 receives sheet material from a right side of graphic box 104 or from a left side of graphic box 104. The printed graphics on the sheet material include indicia indicative of the merchandise being held in merchandiser box 102 and generally promote, highlight or otherwise advertise the merchandise that is to be displayed within the interior space of merchandiser box 102.

In addition, depth 132 (FIG. 13) of graphic box 104 is substantially similar to the depth 135 (FIG. 8) of bottom 118. These substantially similar depths allow graphic box 104 to keep the printed graphic located in sign holder 106 flush with the front of merchandiser box 102 while also preventing the printed graphic located in sign holder 106 from being pushed back into the interior space of merchandiser box 102.

Price holder 108 is positioned just behind front 116 of merchandiser box 102 and within window 117. Price holder 108 is configured to hold sheet material with a printed price (i.e. a price label). In one embodiment and as illustrated, price holder 108 is made of transparent plastic and includes an open top and a closed bottom. The front of the price holder is flexible such that it can be pulled out to insert the price label. Therefore, a price label is inserted into price holder 108 in a top down fashion. The printed price on the sheet material relates to the price or sale price of the merchandise that is to be displayed within the interior space of merchandiser box 102.

As illustrated in the embodiment in FIGS. 1, 2 and 4, price holder 108 is located at a bottom of opening or window 117. However, it is possible for price holder 108 to be placed at other locations. In addition and in one embodiment, price holder 108 has a width 109 that is less than width 120 of merchandise box 102, but greater than width 130 of graphic box 104. In particular and as illustrate din FIGS. 1, 2 and 4, width 109 is substantially similar to a width that is approximately the difference between width 119 of merchandiser box 102 and width 130 of graphic box 104. In this way, price label holder 108 extends a distance 109 across opening or window 117 that corresponds with a width or distance of the spacing which merchandise can be displayed in merchandise box 102.

Figure 9:
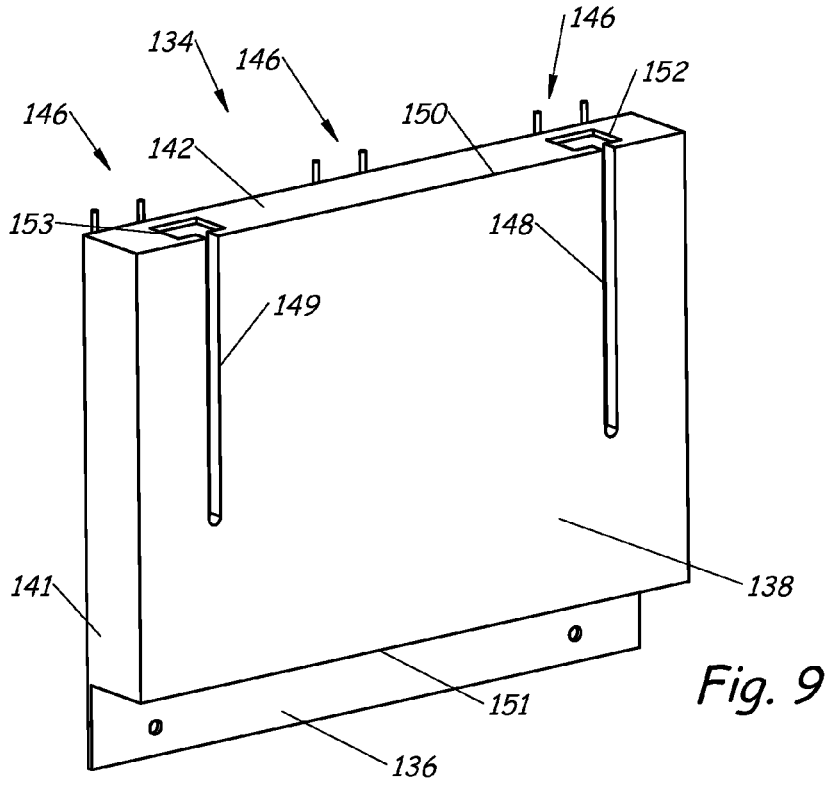
FIG. 9 is a perspective view of an adapter for mounting the portion of the merchandiser illustrated in FIG. 3 to a wall.
Figure 10:
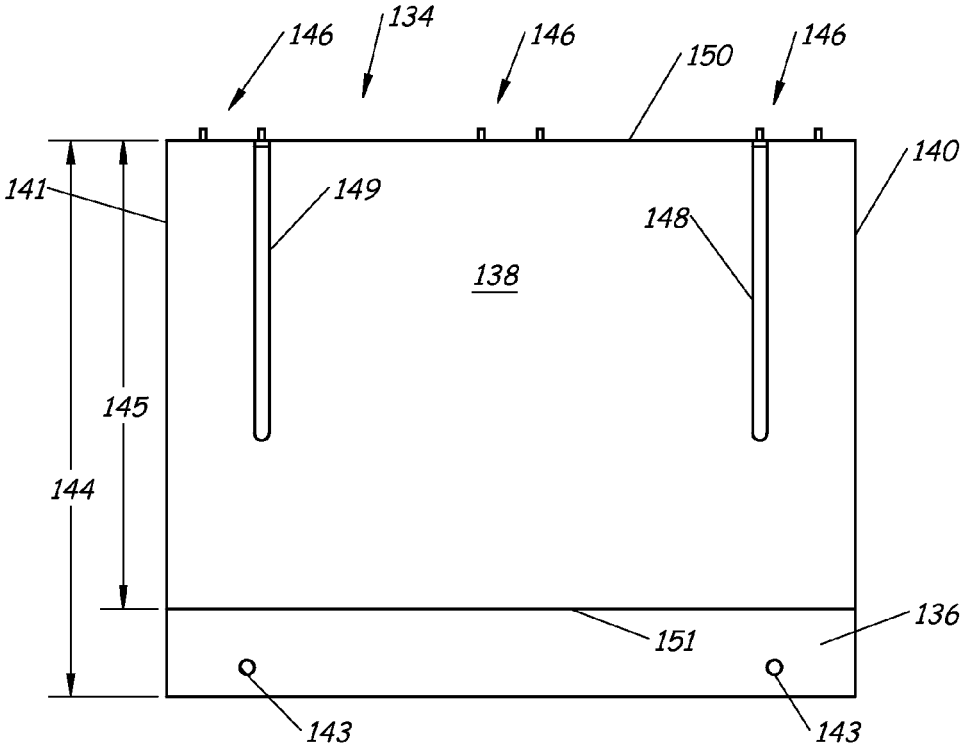
FIG. 10 is a front view of the adapter illustrated in FIG. 9.

In one embodiment, merchandiser 100 further includes an adapter 134. A perspective view of adapter 134 is illustrated in FIG. 9 and a front view of adapter 134 is illustrated in FIG. 10. Adapter 134 is for use in coupling merchandiser box 102 to a wall, such as wall 200 illustrated in the FIG. 1 embodiment. Adapter 134 includes a back panel 136, a front panel 138, a pair of side panels 140 and 141 and a top panel 142. Back panel 136 includes a height 144 that is greater than a height 145 of front panel 138, which means a portion of back panel 136 extends downward from a bottom of front panel 138. This portion of back panel 136 includes a plurality of holes 143 for receiving fasteners so that adapter 134 can be mounted to a wall. In addition, a top of back panel 136 includes a plurality of peg hooks 146. Peg hooks provide additional means for mounting adapter 134 to a wall.

Front panel 138 of adapter 124 includes a pair of slots 148 and 149. However, front panel 138 can have any number of slots including a single slot. Slots 148 and 149 include first ends that extend from and intersect with a top edge 150 of front panel 138 and terminate at second ends located between a bottom edge 151 and top edge 150 of front panel 138. Top panel 142 includes a pair of openings 152 and 153. However, top panel 142 can have any number of openings 152 and 153 including a single opening. Openings 152 and 153 extend from a front edge of top panel 142 and terminate in an area of top panel 142 before a back edge of top panel 142. In addition, opening 152 intersects with slot 148 and opening 153 intersects with slot 149.

Figure 11:
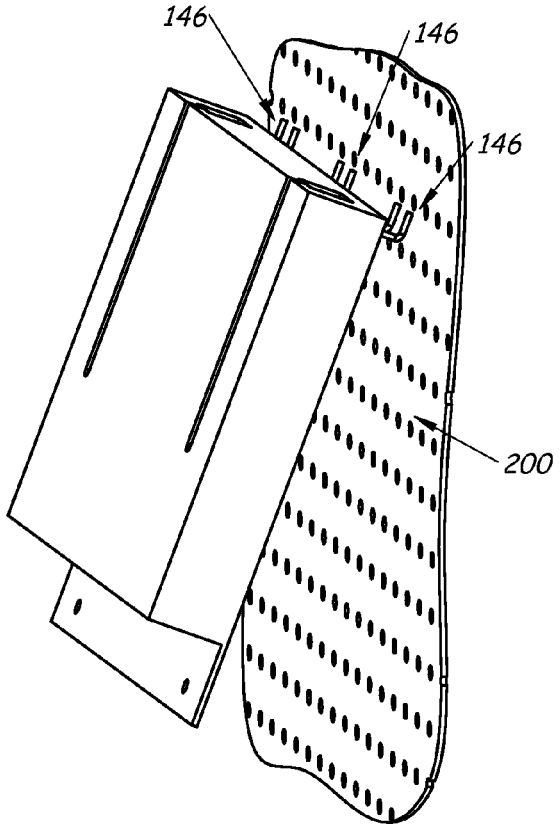
FIG. 11 illustrates the adapter in FIG. 9 being coupled to a wall.
Figure 12:
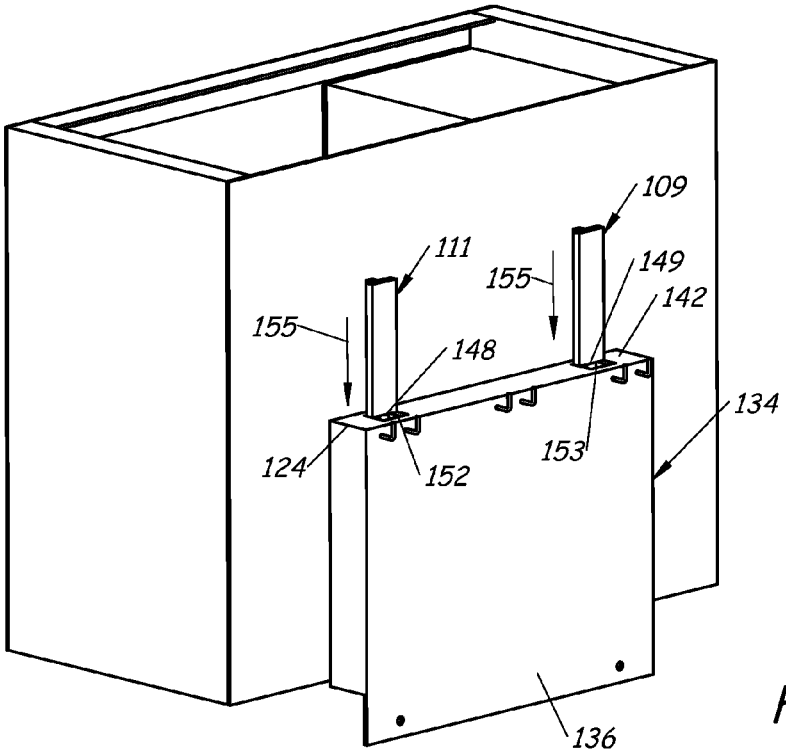
FIG. 12 illustrates a merchandiser box being coupled to the adapter.

FIGS. 11-13 illustrate a method of displaying merchandise in merchandiser 100 in the embodiment illustrated in FIG. 1. In FIG. 1, merchandiser 100 is mounted to a wall so as to appear to float over shelves on a display fixture or display unit. FIG. 11 illustrates adapter 124 of merchandiser 100 being coupled to or mounted to wall 200. As discussed above adapter 124 is for use in mounting merchandiser box 102 to wall 200. As illustrated in FIG. 11, peg hooks 146 are inserted into holes in wall 200 to couple adapter 124 to wall 200. In addition and not illustrated in FIGS. 11-13, fasteners are inserted through holes 143 in back panel 136 to secure a bottom of adapter 124 to wall 200.

FIG. 12 illustrates merchandiser box 102 being coupled or mounted to adapter 124 to thereby be mounted to wall 200. As illustrated, the profile of openings 152 and 153 in top panel 142 of adapter 124 and the profile of slots 148 and 149 in front panel 138 of adapter together correspond to the profile of hooks 109 and 111. In other words, main bodies 117 and 119 of hooks 109 and 111 mate with or are inserted into openings 153 and 152 in adapter 124 along direction 155. Simultaneously, bases 113 and 115 of hooks 109 and 111 mate with or are inserted into slots 149 and 148 in adapter 124 along direction 155 such that bases 113 and 115 are positioned within and extend along slots 149 and 148. Therefore, adapter 124 supports merchandise box 102 via hooks 109 and 111.

FIG. 13 illustrates graphic box 104 being inserted into merchandiser box 102. In particular, graphic box 104 is inserted through opening or window 117 in a direction 157 and into the interior space of merchandiser box 102. The bottom of graphic box 104 rests on bottom interior surface 103 of merchandiser box 102 and is located between the pair of sides 112 and 114 of merchandiser box 102, between window 117 and back 110 and between bottom 118 and top 120 of merchandiser box 102. Furthermore and as discussed above, in one embodiment, graphic box 104 is located adjacent side 114. In addition and as also previously discussed, sign holder 106 is attached to a front surface of front 124 of graphic box 104. After graphic box 104 is inserted into merchandiser box 102, sign holder 106 receives sheet material having printed graphics or indicia that relate to the merchandise that is to be displayed or held in the remaining of the interior space of merchandiser box 102. In other words, sheet material having printed graphics is slid into sign holder 106. Still further, after graphic box 104 is inserted into merchandiser box 102, price holder 108 receives a price label that relates to the merchandise that is to be displayed or held in the remaining of the interior space of merchandiser box 102. In other words, a price label having a printed price is slid into price holder 108.

Figure 14:
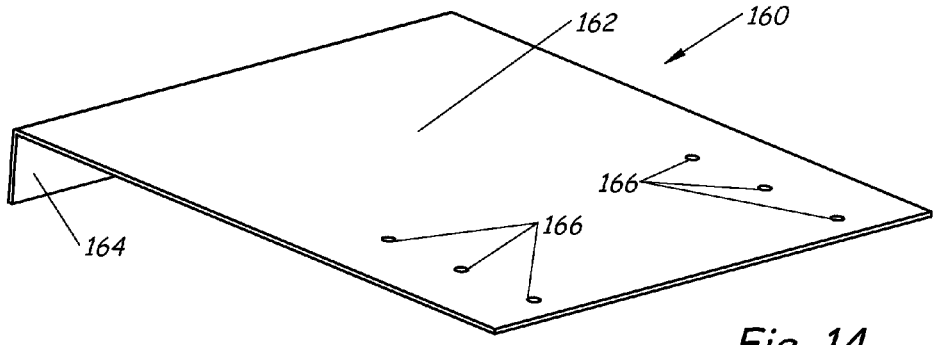
FIG. 14 is a perspective view of a paddle for mounting the portion of the merchandiser illustrated in FIG. 3 to a shelf.

In another embodiment, merchandiser 100 further includes a paddle 160. A perspective view of paddle 160 is illustrated in FIG. 14. Paddle 160 is for use in coupling and fixing merchandiser box 102 to a shelf, such as shelf 202 illustrated in the FIG. 2 embodiment. Paddle 160 includes a main panel 162 and a lip 164. Lip 164 is oriented substantially perpendicular to main panel 162 and extends from a back edge of main panel 162. Main panel 162 includes a plurality of holes 166 for receiving fasteners so that paddle 160 can be mounted to a shelf.

Figure 15:
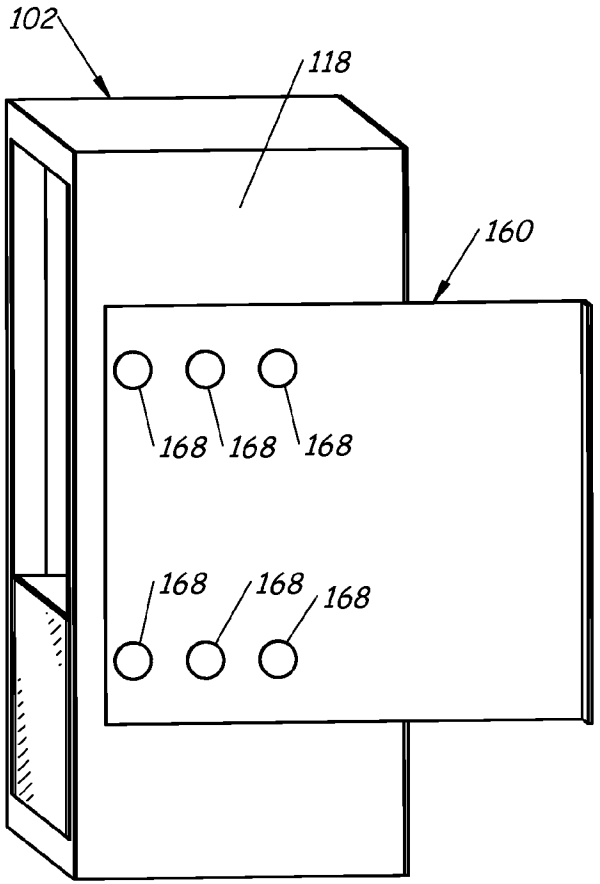
FIG. 15 illustrates the paddle being coupled to the merchandiser box.

FIGS. 15-18 illustrate a method of displaying merchandise in merchandiser 100 in the embodiment illustrated in FIG. 2. In FIG. 2, merchandiser 100 is secured to a shelf 202 on a display fixture or display unit. FIG. 15 illustrates paddle 160 of merchandiser 100 being coupled to bottom panel 118 of merchandise box 102. As illustrated in FIG. 15, fasteners 168 are inserted through holes 166 in paddle 160 and coupled to bottom 118 of merchandiser box 102.

Figure 17:
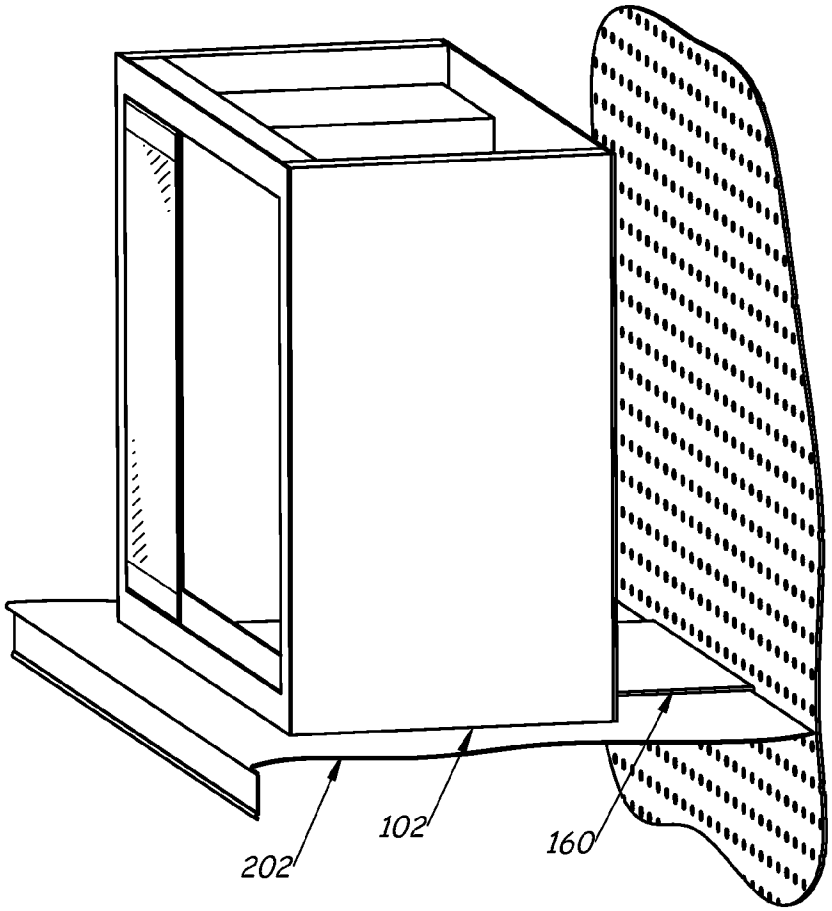
FIGS. 16 and 17 illustrate the merchandiser box being attached to the shelf using the paddle.
Figure 16:
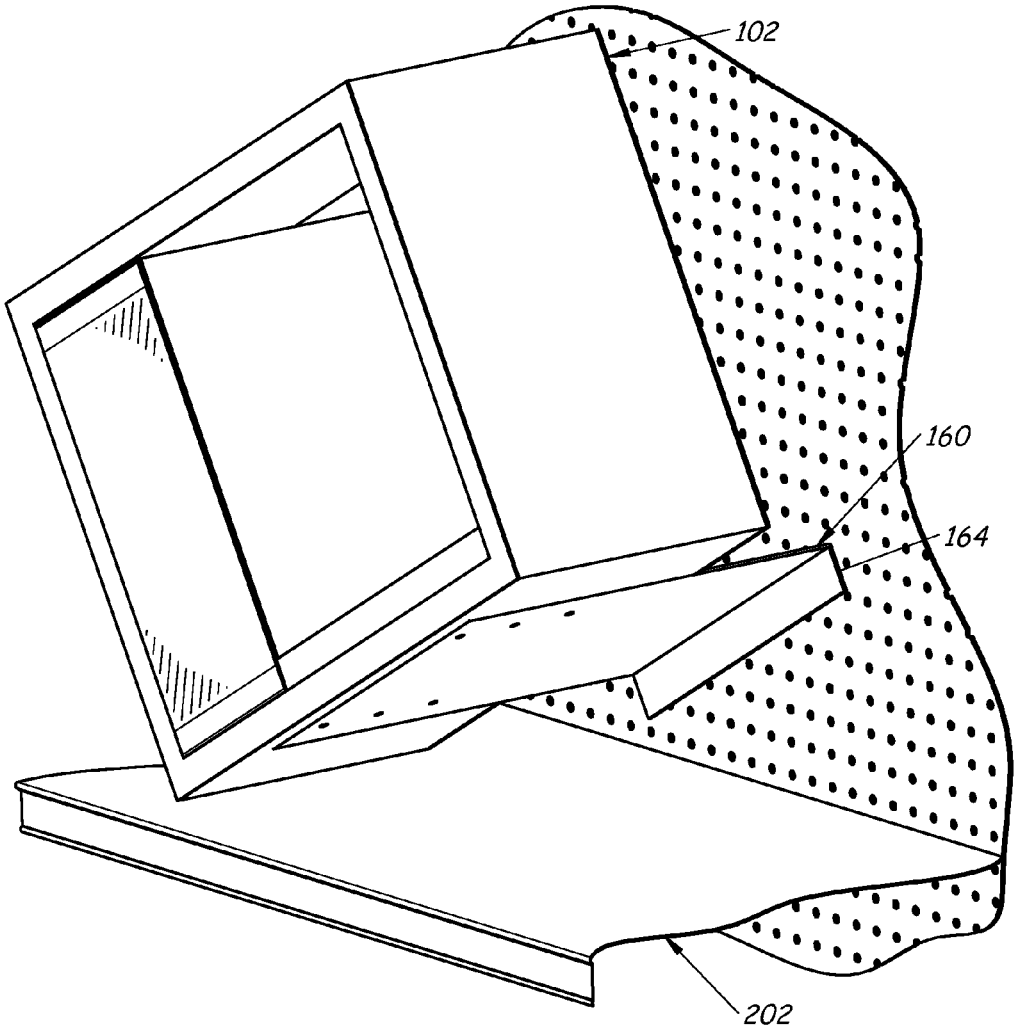

FIGS. 16 and 17 illustrates merchandiser box 102 being mounted to shelf 202 using paddle 160. As illustrated, back panel 164 is inserted between a wall 200 of a display fixture or display unit and shelf 202. This not only secures merchandiser box 102 to shelf 202, but also prevents merchandiser box 102 from sliding off the front of shelf 202. The distance between holes 166 which receive fasteners and back panel 164 allow merchandise box 102 to be placed toward the front of shelf 202.

Figure 18:
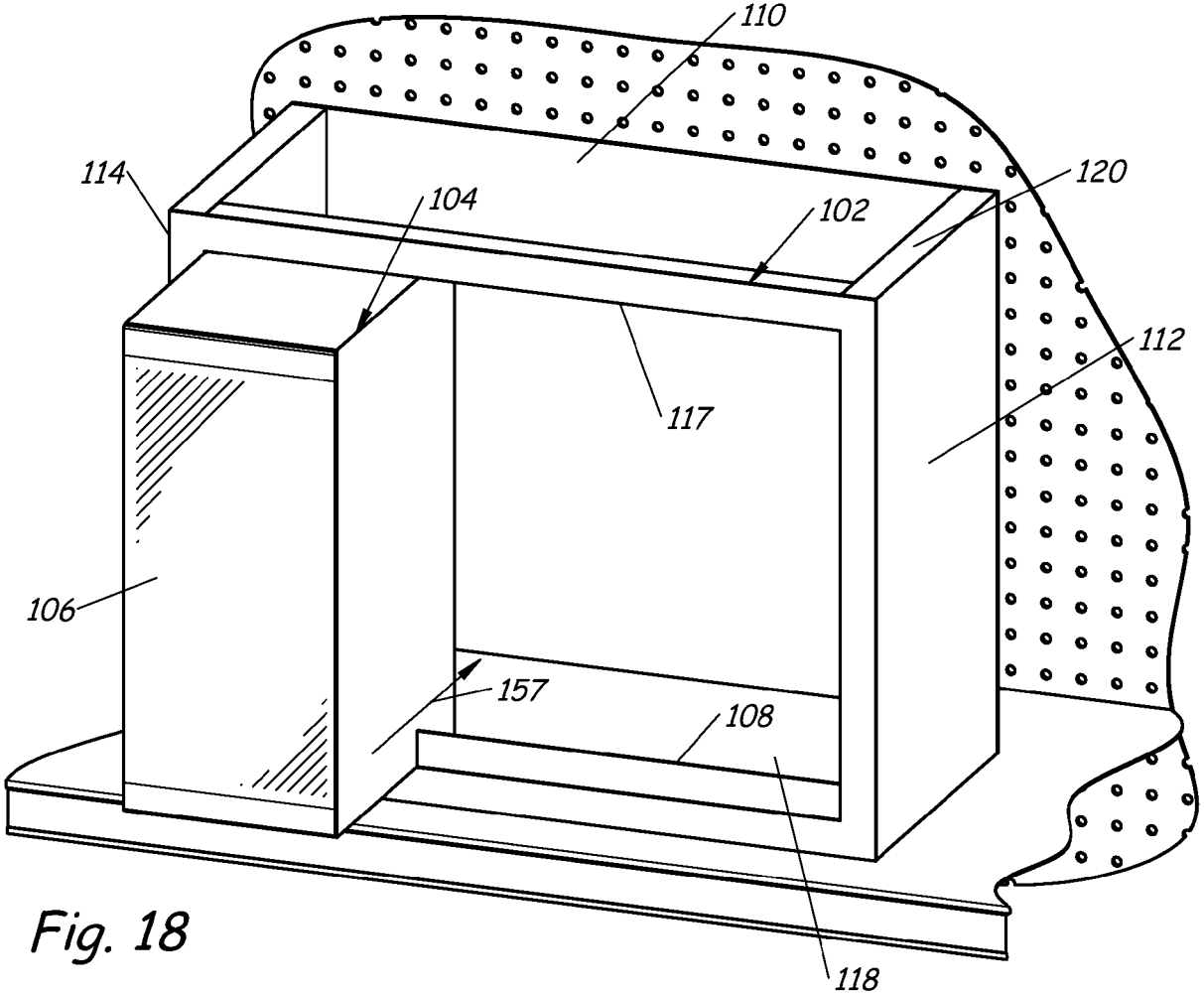
FIG. 18 illustrates the graphic box being inserted into merchandiser box.

FIG. 18 illustrates graphic box 104 being inserted into merchandiser box 102 in the embodiment of FIG. 2. In particular, graphic box 104 is inserted through opening or window 117 in a direction 157 into the interior space of merchandiser box 102. The bottom of graphic box 104 rests on bottom 118 of merchandiser box 102 and is located between the pair of sides 112 and 114 of merchandiser box 102, between window 117 and back 110 and between bottom 118 and top 120 of merchandiser box 102. Furthermore and as discussed above, in one embodiment, graphic box 104 is located adjacent side 114. In addition and as also previously discussed, sign holder 106 is attached to a front surface of front 124 of graphic box 104. After graphic box 104 is inserted into merchandiser box 102, sign holder 106 receives sheet material having printed graphics or indicia that relate to the merchandise that is to be displayed or held in the remaining of the interior space of merchandiser box 102. In other words, sheet material having printed graphics is slid into sign holder 106. Still further, after graphic box 104 is inserted into merchandiser box 102, price holder 108 receives a price label that relates to the merchandise that is to be displayed or held in the remaining of the interior space of merchandiser box 102. In other words, a price label having a printed price is slid into price holder 108.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A display apparatus comprising:

a merchandiser box having an exterior bottom surface and an interior space defined by a back, a pair of sides, an interior bottom surface, a top and a front having a window, wherein the interior space supports and displays merchandise and wherein the window is defined by a perimeter having a bottom, a left side, a top and a right side;

an adapter configured to couple the back of the merchandiser box to a wall of a display fixture such that the exterior bottom surface of the merchandiser box is exposed along its entirety, and includes a back panel, a front panel, a pair of side panels and a top panel, wherein the front panel has at least one slot and the top panel includes at least one opening that intersects with the at least one slot in the front panel and wherein the at least one opening and the at least one slot are configured to slidingly receive at least one corresponding profile located on an exterior of the back of the merchandiser box; and a graphic box being insertable through the window and located completely within the interior space of the merchandiser box such that a bottom of the graphic box rests on the interior bottom surface of the interior space of the merchandiser while located within the interior space of the merchandiser box and includes a front having a sign holder attached to a front surface of the front of the graphic box for holding and viewing sheet material with printed graphics, a back, a right side, a left side, a top and a bottom, wherein the graphic box is located in the merchandiser box between the pair of sides of the merchandiser box, between the front and the back of the merchandiser box, between the top and the bottom of the merchandiser box and the front of the graphic box faces out the window of the merchandiser box.

2. The display apparatus of claim 1, wherein one of the right or left sides of the graphic box is located adjacent to one of the sides of the interior space of the merchandiser box when completely located within the interior space of the merchandiser box.

3. The display apparatus of claim 1, wherein the merchandiser box comprises a width and the graphic box comprises a width, wherein the width of the graphic box is less than the width of the merchandiser box.

4. The display apparatus of claim 3, further comprising a price label holder positioned in the window of the merchandiser box so that the price label holder runs adjacent to a portion of the bottom of the perimeter of the window and is configured to receive a price label.

5. The display apparatus of claim 4, wherein the price label holder comprises a width that is less than the width of the merchandiser box, but greater than the width of the graphic box such that the price label holder extends across a portion of the bottom of the perimeter of the window in the front of the merchandiser box.

6. The display apparatus of claim 1, wherein the adapter comprises a plurality of peg hooks coupled to the back panel for coupling the adapter to the wall.

7. The display apparatus of claim 6, wherein the adapter comprises a plurality of holes in the back panel for receiving fasteners for further attaching to the wall.

8. A merchandiser comprising:

a base structure having an interior space defined by a back panel, a pair of side panels, a bottom panel, a top, a front having an opening defined by a perimeter having a bottom, a left side, a top and a right side, the base structure having a width and configured to display merchandise within the interior space and the opening in the base structure having a width;

a graphic support structure including a front having a front surface, a back, a right side, a left side, a top, a bottom and a width that is less than the width of the opening in the base structure, the graphic support structure being insertable through the opening in the front of the base structure and located completely within the interior space of the base structure such that the bottom of the graphic support structure rests on the bottom panel of the base structure and while located within the interior space is positioned between the pair of side panels, between the front and the back panel between the top and the bottom panel of the base structure and wherein the front surface of the front of the graphic support structure faces out the opening in the base structure and includes a sign holder attached to the front surface of the front of the graphic support structure and configured to hold sheet material with printed graphics; and a price label holder positioned in the opening of the base structure and extending adjacent to a portion of the bottom of the perimeter of the opening in the front of the base structure and configured to receive a price label, wherein the price label holder comprises a width that is less than a width of the opening in the base structure so that the graphic box can slide in and out of the merchandiser box unobstructed by the price label holder.

9. The merchandiser of claim 8, wherein one of the right or left sides of the graphic support structure is located adjacent to one of the pair of side panels of the base structure when the graphic support structure is located in the interior space of the base structure.

10. The merchandiser of claim 8, further comprising an adapter coupled to a wall of a display unit and coupled to the back panel of the base structure, wherein the adapter mounts the base structure to the wall and includes at least one slot for receiving a hook located on a back of the back panel of the base structure.

11. The merchandiser of claim 8, wherein the adapter comprises a plurality of peg hooks for coupling the adapter to the wall of the display unit.

12. The merchandiser of claim 10, wherein the adapter comprises a back panel that includes a plurality of holes for receiving fasteners for attaching to the wall of the display unit.

13. The merchandiser of claim 8, further comprising a paddle coupled to the bottom panel of the base structure and having a lip for inserting between a wall of a display unit and a shelf of the display unit, wherein the paddle holds the base structure secure to the shelf.

14. A merchandiser comprising:

a merchandiser box for holding merchandise mounted to a wall and spaced apart from shelves of a display fixture, the merchandiser box having an interior space defined by a back, a pair of sides, a bottom, a top and a front window having a width, wherein the front window is defined by a perimeter having a bottom, a left side, a top and a right side; and a graphic box including a front having a front surface, a back, a right side, a left side, a top and a bottom, wherein the graphic box is insertable through the front window and entirely located in the interior space of the merchandiser box such that the bottom of the graphic box rests on the bottom of the merchandiser box and while located within the interior space is positioned between the pair of sides, the front window and the back and the top and the bottom of the merchandiser box; and a graphic holder attached to the front of the graphic box for holding and viewing sheet material with printed graphics including indicia indicative of the merchandise being held in the merchandiser box, wherein the front surface of the front of the graphic support structure and the graphic holder faces out the front window in the merchandiser box; and a price label holder positioned in the front window of the merchandiser box and extending adjacent a portion of the bottom of the perimeter of the front window and is configured to receive a price label, wherein the price label holder comprises a width that is less than a width of the front window of the merchandiser box so the graphic holder can slide in and out of the merchandiser box unobstructed by the price label holder.

15. The merchandiser of claim 14, wherein the merchandiser box is mounted to the wall by sliding at least one hook located on an exterior of the back of the merchandiser box into a slot on an adapter that is mounted to the wall.

* * * * *